US008549797B1

(12) United States Patent
Ricketts

(10) Patent No.: US 8,549,797 B1
(45) Date of Patent: Oct. 8, 2013

(54) TORNADO SHELTER

(76) Inventor: Thomas J. Ricketts, Coalport, PA (US)

( * ) Notice: Subject to any disclaimer, the term of this patent is extended or adjusted under 35 U.S.C. 154(b) by 0 days.

(21) Appl. No.: 13/526,669

(22) Filed: Jun. 19, 2012

(51) Int. Cl.
*E04B 1/32* (2006.01)

(52) U.S. Cl.
USPC ..... 52/81.2; 52/81.1; 52/81.4; 52/79.4; 52/80.1

(58) Field of Classification Search
USPC ..... 52/79.1–79.14, 80.1–80.2, 81.1–81.6, 52/82, 292, 745.07, 294, 102, 104, 900, 22; 135/102, 104, 98, 908
See application file for complete search history.

(56) References Cited

U.S. PATENT DOCUMENTS 4,126,972 A * 11/1978 Silen ..... 52/34
5,313,763 A * 5/1994 Oram ..... 52/80.2
5,956,907 A 9/1999 Martin
6,061,976 A 5/2000 Willbanks, Jr.
6,131,343 A 10/2000 Jackson, Jr.
6,393,776 B1 5/2002 Waller
6,415,558 B1 7/2002 Cherry
D466,220 S 11/2002 Watson
8,297,282 B2 * 10/2012 Holley et al. ..... 128/205.26
2005/0210767 A1 * 9/2005 DeFever et al. ..... 52/80.1
2007/0251159 A1 * 11/2007 Wagner ..... 52/19
2008/0155932 A1 * 7/2008 McIntyre et al. ..... 52/653.2
2008/0295450 A1 * 12/2008 Yogev ..... 52/783.1

* cited by examiner

*Primary Examiner* — Jeanette E. Chapman

(57) ABSTRACT

The tornado shelter is constructed of a shell and supports forming an enclosure that is secured to a concrete slab. The tornado shelter is designed for indoor or outdoor use as a safety shelter during severe weather events including dangerous wind speeds. The shell of the tornado shelter is constructed of an inner shell layer and an outer shell layer that sandwich the supports therein. The shell includes a layer of extensive padding along an inner surface to protect occupants from injuries associated with impacting the inner layer. The shape of the shell includes a low-profile curvature that is aerodynamic in order to resist reaction to high wind speeds. A GPS locator alarm located inside of the enclosure is actuated in an emergency and provides location based date to emergency response personnel in order to locate the tornado shelter and occupants associated there with.

7 Claims, 6 Drawing Sheets

TORNADO SHELTER

CROSS-REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of shelters, more specifically, a protective shelter for use during a tornado or severe weather even including dangerous wind speeds.

B. Discussion of the Prior Art

As will be discussed immediately below, no prior art discloses a storm shelter that is constructed of a shell and a plurality of supports forming an enclosure that is secured to a concrete slab via anchor bolts; wherein the shell is lined with extensive padding on the interior, which protects occupants from injuries sustained while inside of the enclosure; wherein the enclosure includes a GPS locator alarm that is actuated in an emergency in order to provide location based data to emergency response personnel in order to locate the storm shelter and occupants located therein; wherein the storm shelter is adaptive for use indoors or outdoors, and provides a safety shelter for occupants in the event of a severe weather event that includes dangerous wind speeds, such as tornados; wherein the storm shelter features a low-profile curvature that is aerodynamic, which resists forces associated with dangerous wind speeds; wherein the shell is constructed of an inner shell layer and an outer shell layer, which collectively sandwich the supports therein.

The Jackson, Jr. Patent (U.S. Pat. No. 6,131,343) discloses a storm shelter apparatus that can be installed above ground or below ground and provides a padded, reinforced shelter to escape a storm. However, the storm shelter does not feature a storm shell that sandwiches supports between an inner layer and an outer layer, and which further provides a soft padding along an inner surface to protect occupants from impacting the interior.

The Waller et al. Patent (U.S. Pat. No. 6,393,776) discloses a storm shelter or structure that can be installed above or below the ground and is anchored in place using concrete. However, the storm shelter is not constructed of the various components and inclusive of a padding along an inner surface for protection of occupants during extreme weather.

The Willbanks, Jr. Patent (U.S. Pat. No. 6,061,976) discloses an easy to install pre-fabricated storm shelter apparatus that is reinforced to prevent being crushed. However, the reinforced apparatus does not feature a low-profile for minimal wind reaction, nor include a padding along an inner surface to protect occupants.

The Martin Patent (U.S. Pat. No. 5,956,907) discloses a pre-fabricated storm shelter for a trailer in which the shelter apparatus is anchored to the ground under the trailer. However, the shelter is uniquely designed for use with a trailer, and is not a shelter that is able to be installed indoors or outdoors, and which provides inner padding among other things.

The Cherry Patent (U.S. Pat. No. 6,415,558) discloses an easy to assembly'reinforced storm shelter that can be constructed indoors or outdoors as needed. However, the storm shelter does not include a low-profile curvature to said shelter, which is aerodynamically capable of resisting wind forces, and which excludes padding along an inner surface.

The Watson Patent (U.S. Pat. No. Des. 466,220) illustrates a design for a storm shelter, which does not illustrate a padding along an inner surface for use in conjunction with a shelter comprised of a two layered shell that sandiwches a plurality of supports.

While the above-described devices fulfill their respective and particular objects and requirements, they do not describe a storm shelter that is constructed of a shell and a plurality of supports forming an enclosure that is secured to a concrete slab via anchor bolts; wherein the shell is lined with extensive padding on the interior, which protects occupants from injuries sustained while inside of the enclosure; wherein the enclosure includes a GPS locator alarm that is actuated in an emergency in order to provide location based data to emergency response personnel in order to locate the storm shelter and occupants located therein; wherein the storm shelter is adaptive for use indoors or outdoors, and provides a safety shelter for occupants in the event of a severe weather event that includes dangerous wind speeds, such as tornados; wherein the storm shelter features a low-profile curvature that is aerodynamic, which resists forces associated with dangerous wind speeds; wherein it the shell is constructed of an inner shell layer and an outer shell layer, which collectively sandwich the supports therein. In this regard, the tornado shelter departs from the conventional concepts and designs of the prior art.

SUMMARY OF THE INVENTION

The tornado shelter is constructed of a shell and supports forming an enclosure that is secured to a concrete slab. The tornado shelter is designed for indoor or outdoor use as a safety shelter during severe weather events including dangerous wind speeds. The shell of the tornado shelter is constructed of an inner shell layer and an outer shell layer that sandwich the supports therein. The shell includes a layer of extensive padding along an inner surface to protect occupants from injuries associated with impacting the inner layer. The shape of the shell includes a low-profile curvature that is aerodynamic in order to resist reaction to high wind speeds. A GPS locator alarm located inside of the enclosure is actuated in an emergency and provides location based date to emergency response personnel in order to locate the tornado shelter and occupants associated there with.

An object of the invention is to provide a storm shelter that is constructed of a shell formed of an inner shell layer and an outer shell layer that sandwich supports there between.

A further object of the invention is to provide a layer of padding along an inner surface of the shell, which protects the occupants form injuries associated with impacting the inner surface, which may occur during dangerous wind speeds of an extreme weather event such as a tornado.

A further object of the invention is to provide a storm shelter that can be installed indoors or outdoors.

A further object of the invention is to provide a GPS located device inside of the storm shelter, which can be used in an emergency to provide location based data to emergency service personnel in order to locate the storm shelter and occupants associated there with.

A further object of the invention is to include a rubber insulator that is affixed to an exterior surface of the shell to provide additional protection in the event that the tornado shelter is impacted by an object from outside of the shelter.

These together with additional objects, features and advantages of the tornado shelter will be readily apparent to those of ordinary skill in the art upon reading the following detailed description of presently preferred, but nonetheless illustrative, embodiments of the tornado shelter when taken in conjunction with the accompanying drawings.

In this respect, before explaining the current embodiments of the tornado shelter in detail, it is to be understood that the tornado shelter is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the tornado-shelter.

It is therefore important that the claims be regarded as including such equivalent construction insofar as they do not depart from the spirit and scope of the tornado shelter. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
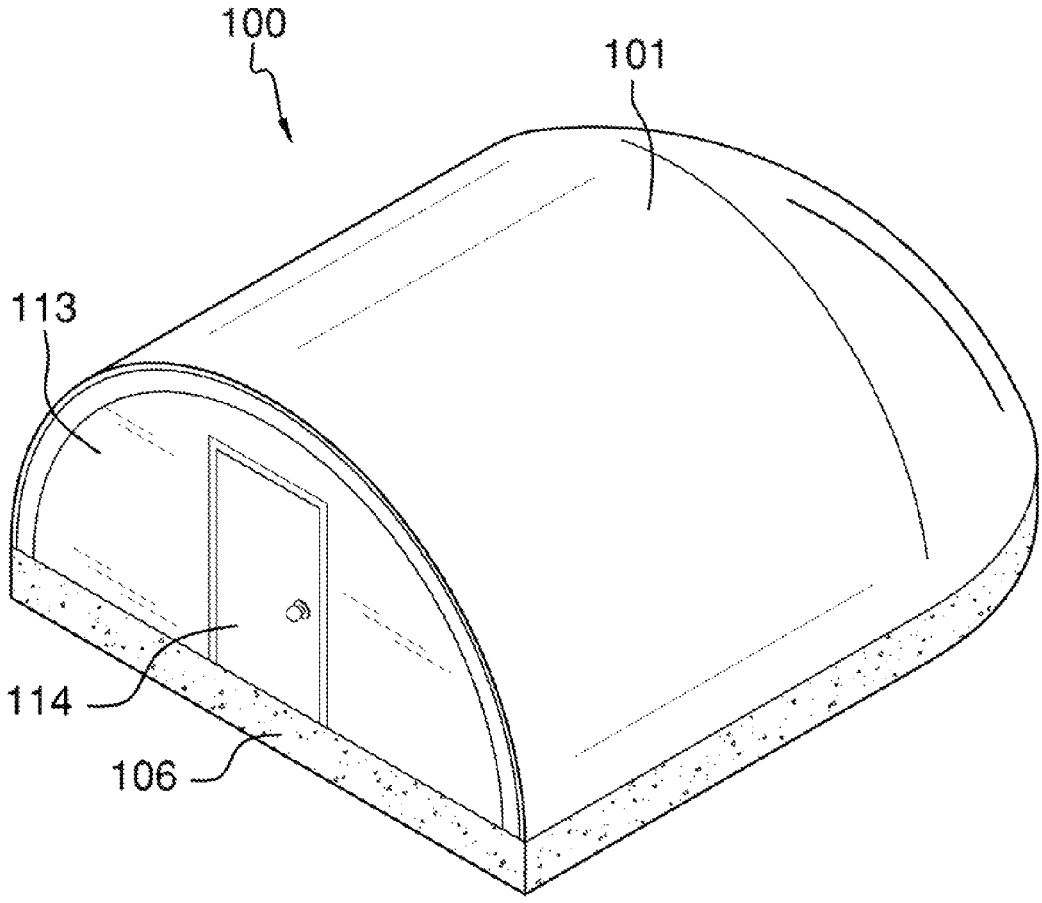
FIG. 1 illustrates a perspective view of the tornado shelter wherein the concrete slab is visible from underneath the shell, and which includes a low-profile curvature that resists reaction with high speeds.
Figure 2:
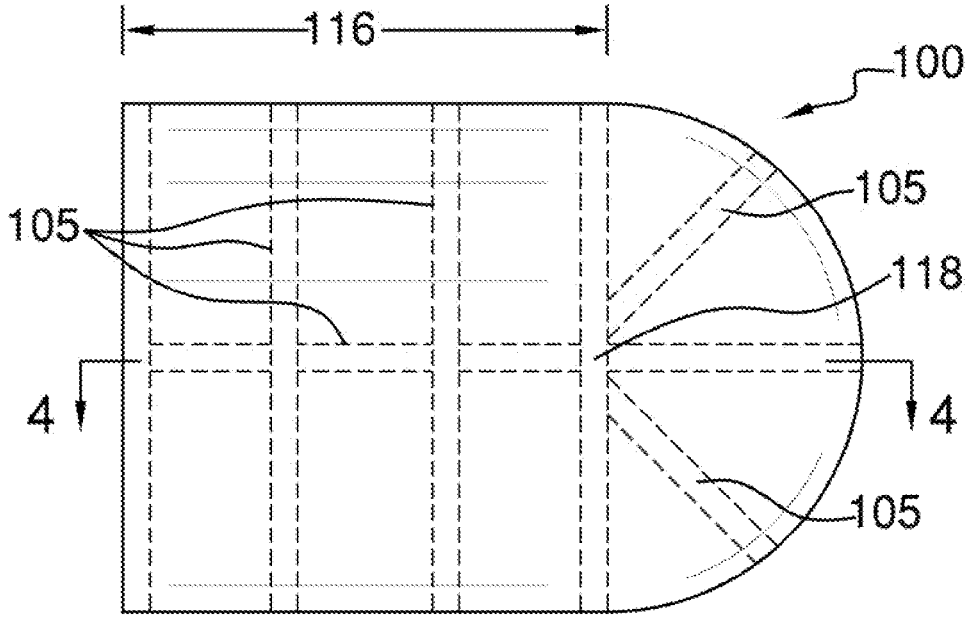
FIG. 2 illustrates a top view of the tornado shelter in which the supports are depicted in broken lines.
Figure 3:
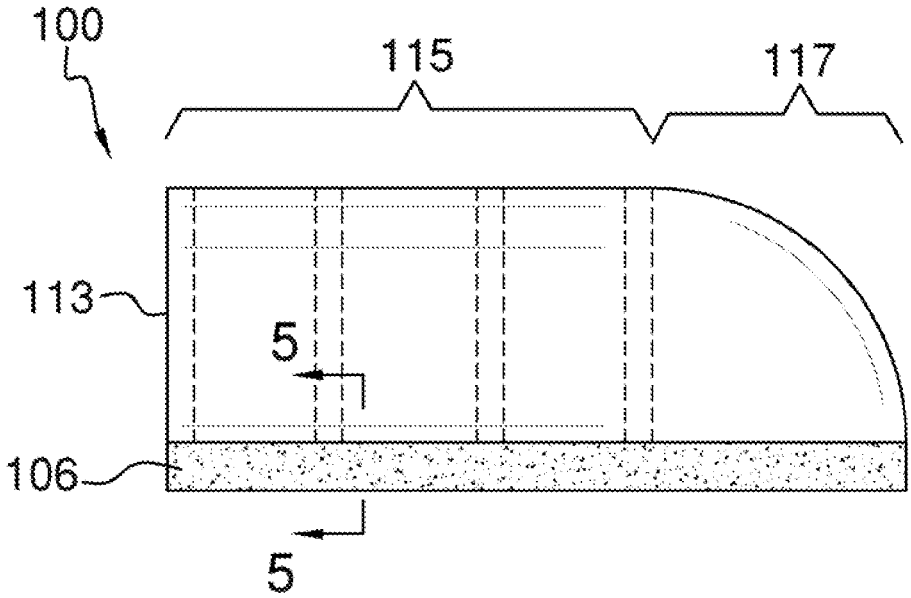
FIG. 3 illustrates a side view of the tornado shelter with broken lines depicting the supports, and depicting the concrete slab located beneath the shell.
Figure 4:
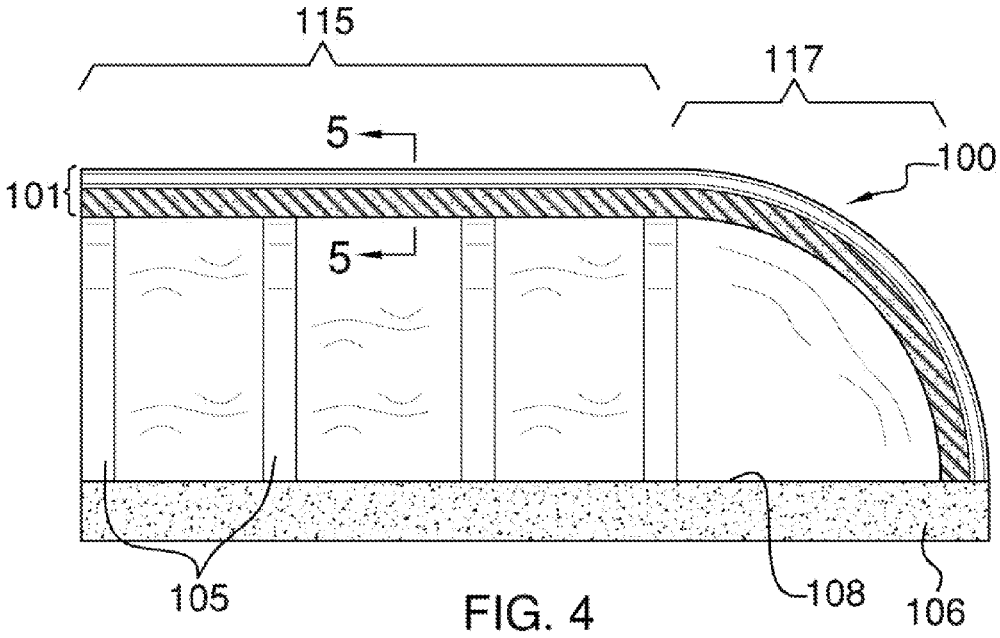
FIG. 4 illustrates a cross-sectional view of the tornado shelter along line 4-4 in FIG. 2, and detailing the padding aligning the interior surface of the shell.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-8. A tornado shelter 100 (hereinafter invention) includes a shell 101 comprised of an inner shell layer 102 and an outer shell layer 103. The inner shell layer 102 and the outer shell layer 103 are separated by a distance 104, which accommodates a plurality of supports 105 therein. The supports 105 provide additional stability to the invention 100, and are anchored to a concrete slab 106 via anchor bolts 107. Moreover, the concrete slab 106 defines a bottom surface 108 with which to rest the shell 101 and the supports 105 arising therefrom. The concrete slab 106 shall be of a slab thickness 106A suitable for securing the shell 101 in a stationary manner in order to brace for and withstand forces associated with dangerous wind speeds.

The inner shell, layer 102 is further defined by an inner surface 109, which is lined with a padding 110. The padding 110 being of no particular thickness 110A is included inside of the shell 101 in order to protect an occupant from impacting the shell 101 when inside. The padding 110 may be constructed of a soft foam such as a visco-elastic foam or memory foam. The padding 110 may alternatively be constructed of a bag containing a plurality of pelletized foam beads that contour the inner surface 109, and which provides ample padding when impacted by an end user.

The shell 101 can be constructed of a plurality of materials. However, it shall be noted that the particular material used in connection with the construction of the shell 101 shall be of sufficient strength to endure forces associated with dangerous wind speeds. Therefore, the material used in the construction of the shell 101 is likely made of a metal, such as a carbon steel, a stainless steel, aluminum, titanium, or other high-strength metal. The shell 101 may also be constructed of a carbon fiber composite as an alternative material for use in the construction of the invention 100. The inner shell layer 102 and the outer shell layer 103 may be made of a thickness ranging from as thin as a single millimeter to an inch or more in thickness. Obviously, the use of the material and thickness thereof shall dictate the overall weight of the shell 101, and the ability of the shell 101 to endure dangerous wind speeds and impacts with flying objects that is common with dangerous wind speeds.

Figure 5:
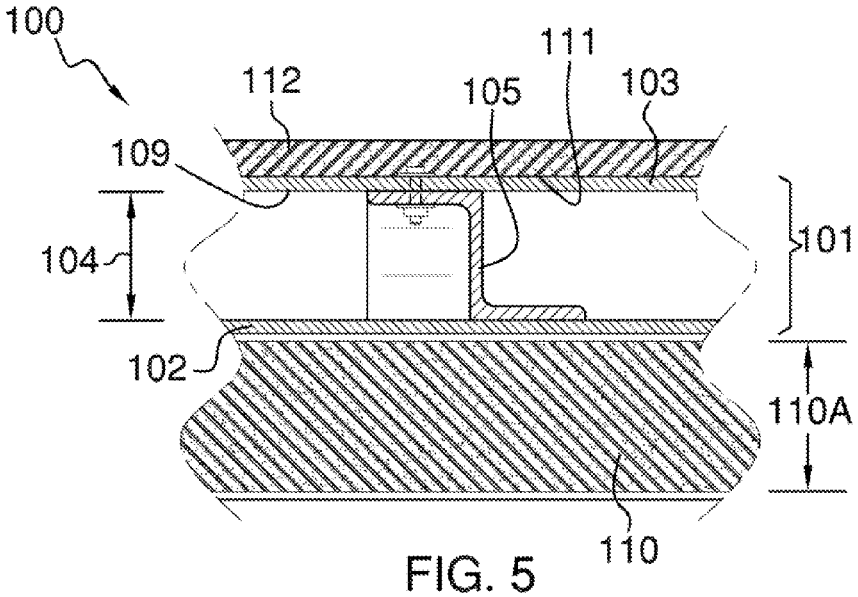
FIG. 5 illustrates a close-up cross-sectional view of the tornado shelter along line 5-5 in FIG. 4, and detailing the inner shell layer and outer shell layer sandwiching a support member in between, while further detailing the padding along the inner surface of the inner shell layer and a rubber insulator included on the outer shell layer.
Figure 6:
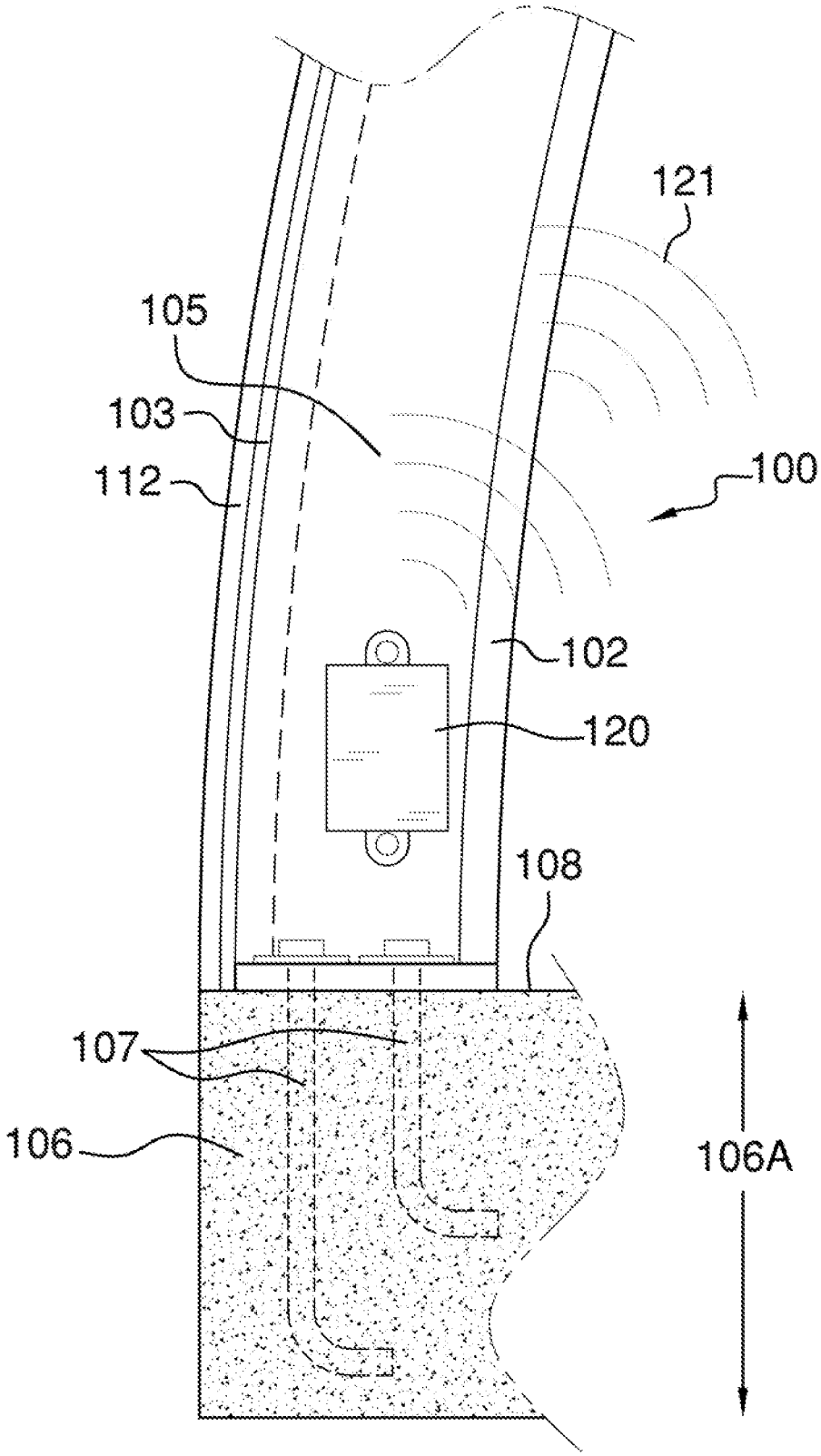
FIG. 6 illustrates a cross-sectional view of the tornado shelter along line 6-6 in FIG. 3, and detailing the anchor bolts used to secure the supports to the concrete slab and the GPS locator alarm mounted to one of the supports.

The outer shell layer 103 is further defined as including an exterior surface 111, which defines the exterior of the shell 101. Referring to FIGS. 5 and 6, the shell 101 may include a rubber insulator 112 that adorns the exterior surface 111 of the outer shell layer 103. Thus, the rubber insulator 112 shall define an outward appearance of the shell 101, and is included as an additional measure designed to protect the shell 101 by absorbing forces associated with dangerous wind speeds and/or impacts with flying objects commonly associated with dangerous wind speeds.

It shall be noted that the term "dangerous wind speeds" is being used to define speeds associated with all categories of tornadoes, which can range from 70 mph to over 200 mph.

The shell 101 shall include a face 113 with a door 114 capable of opening outwardly with respect to the shell 101. The face 113 and the door 114 form a flat surface. The shell 101 extends from the face 113 and forms a semi-circular member 115 that extends an undefined length 116 and adjoins with a hemispherical dome member 117. The curvature of the semi-circular member 115 and the hemispherical dome member 117 provide an aerodynamic benefit to the invention 100 in the ability to resist forces associated with dangerous wind speeds.

It shall be noted that the supports 105 traverse at varying locations inside of the shell 101. In referring to FIG. 2, the supports 105 form a grid along the semi-circular member 115 and are rotatably engaged about a center point 118 of the hemispherical dome member 117.

Referring to FIG. 6, inside of the shell 101 is a GPS locator alarm 120, which is secured to one of the supports 105, and which is able to generate an alarm that is in the form of a wireless, radio transmission 121 to local emergency personnel. Moreover, the alarm generated shall detail the location of the invention 100, and inform said local emergency personnel of the alarm being activated thereby informing the local emergency personnel that dangerous wind speeds have been encountered onto or around the invention 100.

Figure 7:
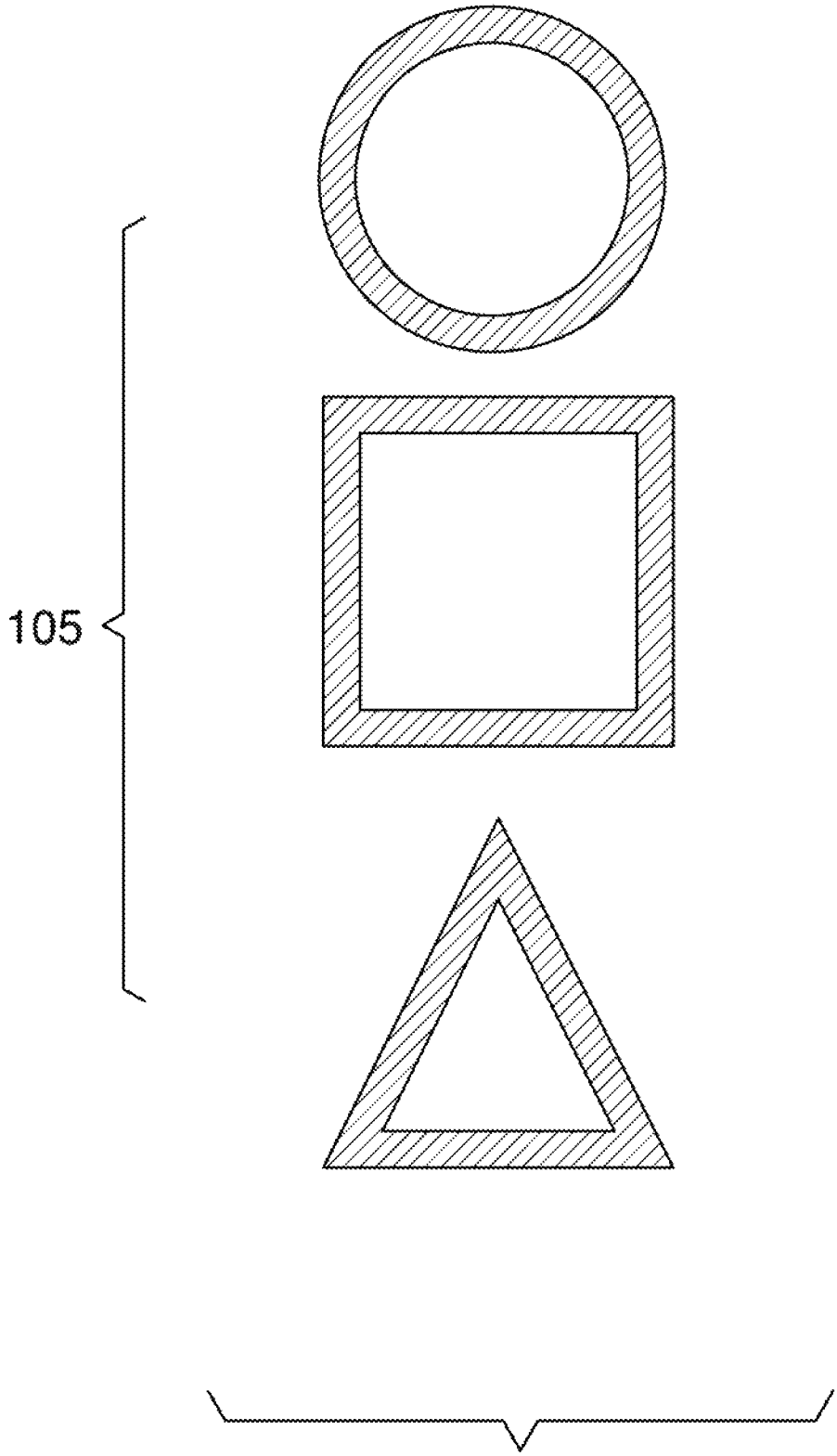
FIG. 7 illustrates a cross-sectional view of the different shapes of a support used in connection with the tornado shelter.

Referring to FIG. 7, the supports 105 may comprise different cross-sectional shapes. The cross-sectional shapes may include a square stock, circular, or a triangular shape.

Figure 8:
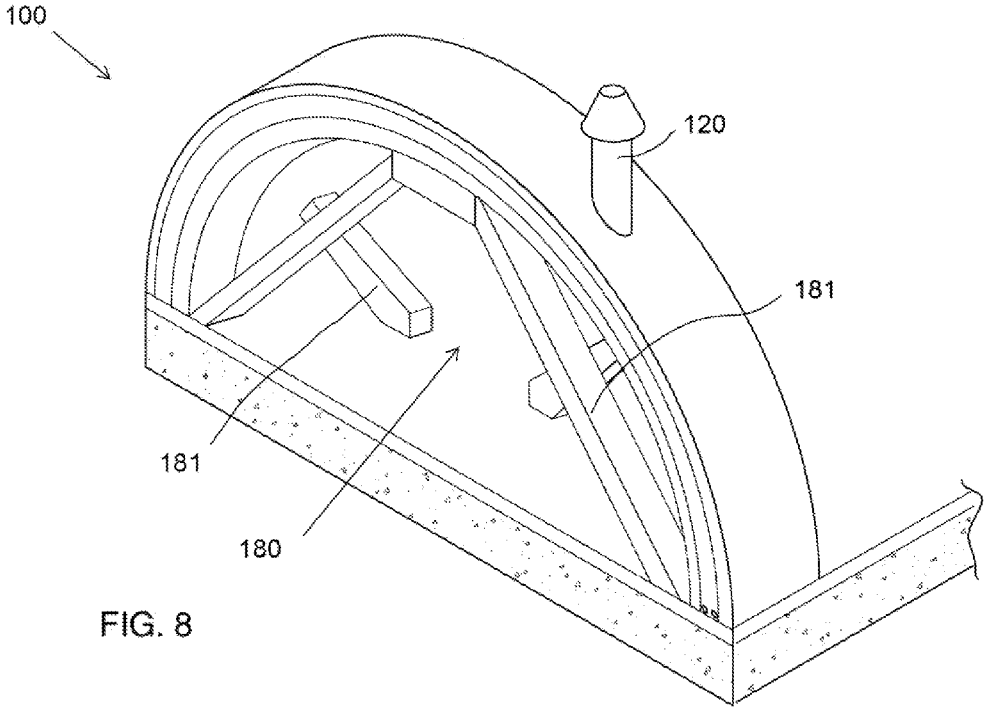
FIG. 8 illustrates a cross-sectional view of the tornado shelter wherein a roll cage is integrated into the interior to further brace and support the interior.

Referring to FIG. 8, the invention 100 may include a roll cage 180 that is mounted to the interior of the invention 100. It shall be noted that the term "roll cage" is being used to analogize the structure integrated inside of the invention 100 with that of a race car or other wheeled vehicle that includes a "roll cage" in order to protect the occupants during an unintended rollover of the associated vehicle. The roll cage 180 is comprised of different cage members 181 oriented inside of the invention 100, and forming acute angles to further support the integrity of the invention 100. Also, it shall be noted that the invention 100 may include the GPS locator alarm 120 outside of the shell 101, and that the GPS locator alarm 120 extends upwardly from the invention 100.

As previously mentioned anchor bolts 107 shall be used to secure the shell 101 and the supports 105 to the concrete slab 106. The anchor bolts 107 resemble "L" shaped bolts that when installed prior to pouring the concrete slab 106, the anchor bolts 107 are rigidly affixed to the concrete slab 106.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A safety shelter for use during severe weather events including dangerous wind speeds comprising:

a shell having a plurality of supports that are anchored to a concrete slab and forming an interior that an end user can occupy as an occupant during dangerous wind speeds associated with extreme weather;

wherein said shell includes padding along an inner surface, which protects said occupant from injuries associated with impacting said shell;

wherein a GPS locator device is included, and can emit an alarm in the form of a wireless transmission to local emergency personnel as to the location of the safety shelter;

wherein the shell is constructed of an inner shell and an outer shell that are separated via a distance to sandwich the supports there between;

wherein the plurality of supports are anchored to the concrete slab via a plurality of anchor bolts;

wherein the outer shell layer being further defined with an exterior surface; wherein a rubber insulator adorns the exterior surface of the outer shell layer;

wherein the shell is further defined with a face having a door that opens outwardly with respect to the shell;

wherein the shell extends from the face and forms a semi-circular member that extends an undefined length and adjoins with a hemispherical dome member;

wherein the GPS locator device is included either inside or outside of the shell.

2. The safety shelter as described in claim 1 wherein a roll cage is integrated inside of the shell.

3. The safety shelter as described in claim 1 wherein the supports have a cross-sectional shape comprising a square, circle, or triangle.

4. A safety shelter for use during severe weather events including dangerous wind speeds comprising:

a shell having a plurality of supports that are anchored to a concrete slab and forming an interior that an end user can occupy as an occupant during dangerous wind speeds associated with extreme weather;

wherein said shell includes padding along an inner surface, which protects said occupant from injuries associated with impacting said shell;

wherein a GPS locator device is included, and can emit an alarm in the form of a wireless transmission to local emergency personnel as to the location of the safety shelter;

wherein the shell is constructed of an inner shell and an outer shell that are separated via a distance to sandwich the supports there between;

wherein the plurality of supports are anchored to the concrete slab via a plurality of anchor bolts;

wherein the outer shell layer being further defined with an exterior surface;

wherein a rubber insulator adorns the exterior surface of the outer shell layer;

wherein the shell is further defined with a face having a door that opens outwardly with respect to the shell;

wherein the shell extends from the face and forms a semi-circular member that extends an undefined length and adjoins with a hemispherical dome member;

wherein the anchor bolts are "L" shaped bolts that are installed prior to pouring of the concrete slab;

wherein the GPS locator device is included either inside or outside of the shell;

wherein a roll cage is integrated inside of the shell.

5. The safety shelter as described in claim 4 wherein the padding has a thickness, and is constructed of a visco-elastic foam.

6. The safety shelter as described in claim 4 wherein the shell is constructed of a metal or carbon fiber composite.

7. The safety shelter as described in claim 4 wherein the supports have a cross-sectional shape comprising a square, circle, or triangle.

* * * * *